United States Patent [19]

Acker

[11] Patent Number: 5,066,259

[45] Date of Patent: Nov. 19, 1991

[54] DOLL STRUCTURE INCORPORATING MATERIAL SIMULATING NATURAL BODY WEIGHT AND FEEL

[76] Inventor: Judith S. Acker, 505 Edinburgh St., San Mateo, Calif. 94402

[21] Appl. No.: 525,236

[22] Filed: May 17, 1990

[51] Int. Cl.[5] ..... A63H 3/36

[52] U.S. Cl. ..... 446/385; 446/369

[58] Field of Search ..... 446/385, 267, 268, 369

[56] References Cited

U.S. PATENT DOCUMENTS

| | | | |
|---|---|---|---|
| 2,606,398 | 8/1952 | Miller | 446/385 |
| 4,618,213 | 10/1986 | Chen | 446/385 X |
| 4,795,397 | 1/1989 | Stevens | 446/369 X |

FOREIGN PATENT DOCUMENTS

| | | | |
|---|---|---|---|
| 2207080 | 1/1989 | United Kingdom | 446/385 |

*Primary Examiner*—Mickey Yu

*Attorney, Agent, or Firm*—John J. Leavitt

[57] ABSTRACT

A doll structure is provided which incorporates a mass of material in selected parts of the doll body to impart to the selected part of the doll a weight factor approximately equivalent to the weight factor of the corresponding part in a human child of approximately the same size. Mats of unoriented filaments are arranged in relation to the weight producing mass or masses to provide bulk and girth to the parts, while selected layers of a soft and pliant elastically compressible material are applied to provide a compressibility to the doll parts substantially equivalent to the compressibility of the corresponding part of a human child. The doll body or its independent parts is covered with a layer of material that simulates the "feel" of human tissue.

5 Claims, 3 Drawing Sheets

FIG 7
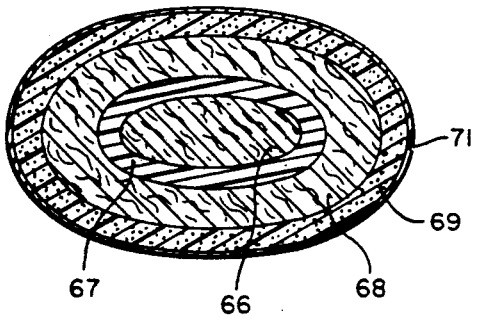
FIG 8
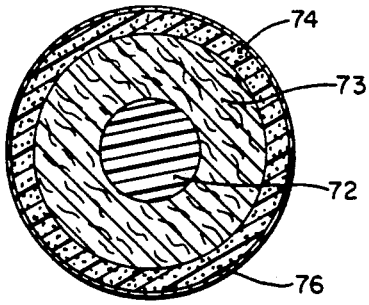
FIG 9
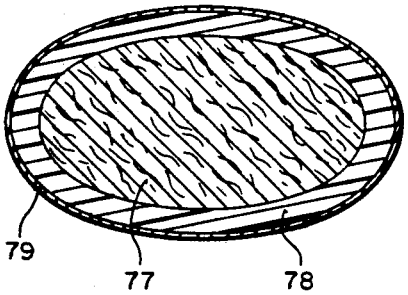
FIG 10
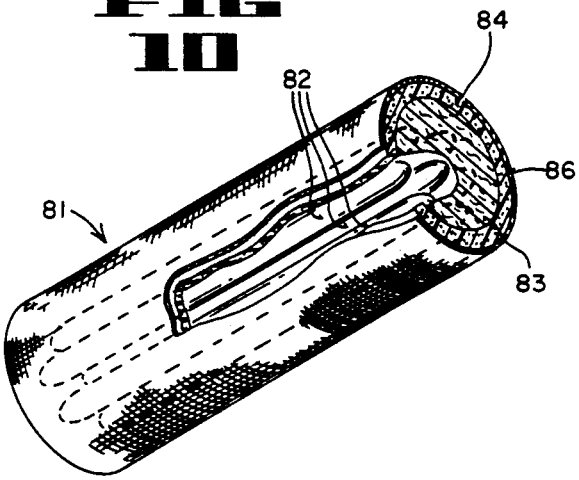
FIG 11
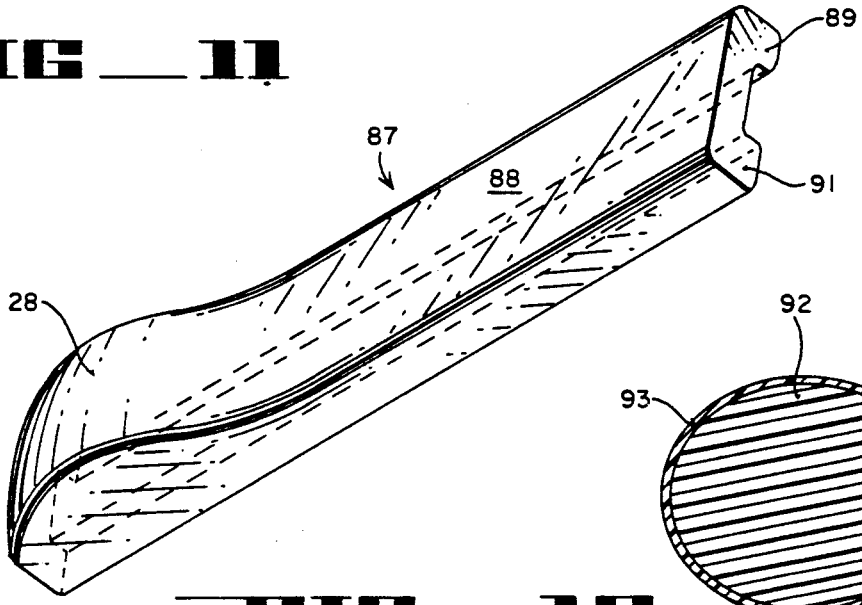
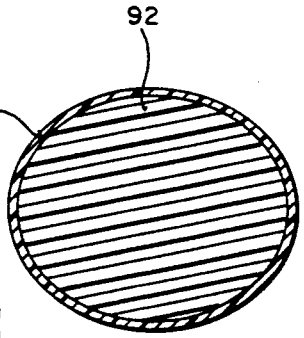
FIG 12

DOLL STRUCTURE INCORPORATING MATERIAL SIMULATING NATURAL BODY WEIGHT AND FEEL

BACKGROUND OF THE INVENTION

1. Field of the Invention

This invention relates to dolls and doll structures, and particularly to a doll structure that incorporates material that provides to the doll structure the weight and feel of a natural human child.

2. Description of the Prior Art

A preliminary patentability and novelty search conducted in Class 446, sub-class 385 has revealed the existence of the following United States patents:

| | | |
|---|---|---|
| 237,559 | 1,979,031 | 3,061,572 |
| 3,816,957 | | 4,268,991 |

U.S. Pat. No. 237,559 refers merely to a celluloid doll, or more accurately, a doll body fabricated from celluloid. There is nothing in this patent that suggests the use of a material in the fabrication of the doll that imparts to the doll body the weight of a natural child, or simulates the "feel" that one experiences when a live human child is touched.

U.S. Pat. No. 1,979,031 relates to dolls, and particularly to the method of rendering the exterior of the doll soft and pliant to simulate the "feel" of a live human child, but this effect is accomplished through the provision of a "coating" that is placed on the doll parts. There is nothing in this patent that suggests the use of a material that lends weight to the doll structure to simulate the weight of a live child, and which also enables the provision of a covering for the doll parts which, in combination with the material that lends realistic weight to the doll structure, also imparts a "feel" to the doll parts that simulates the "feel" of a live human child.

U.S. Pat. No. 3,061,572 does not relate specifically to dolls. Rather, it relates to a mass of a particular type of synthetic resinous material that has characteristics that make it fun to play with. There appears to be nothing in this patent that teaches the use of this particular material, or its equivalent, as a component in the fabrication of doll body parts.

U.S. Pat. No. 3,816,957 is directed to a particular connecting means for connecting relatively soft parts of a doll such as an arm to a shoulder, or a leg to a hip joint. Again, there is nothing in this patent that suggests the use of a material for constructing doll body parts that are possessed of the weight necessary to simulate the weight of a live child, and which possess the pliancy, deformability, and resilience that imparts to doll body parts incorporating the material a "feel" that simulates the "feel" of a live child.

U.S. Pat. No. 4,268,991 is directed to a soft flexible articulated doll that utilizes specially constructed pivotal joints between the head and trunk, and between the legs and the trunk. While the doll body is soft and flexible because it is fabricated from material such as sponge rubber, there is no teaching in this patent that suggests the utilization of a synthetic resinous mass, such as silicone gel, that possesses the weight and "feel" characteristics of a live child, in the fabrication of doll body parts.

Accordingly, it is one of the objects of the present invention to fabricate a doll body utilizing materials that will impart to the doll body the weight and "feel" characteristics that simulate the weight and "feel" of a live child of approximately the same size as the doll.

Another object of the invention is the provision of a doll structure that incorporates in its various parts a silicone gel material or other elasto-polymer that possesses a weight characteristic that imparts to the doll part in which it is incorporated a weight characteristic that simulates the weight of a corresponding part of a live child of approximately the same size.

Doll structures fabricated from artificial materials frequently possess only a generally similar appearance to a live child, largely because of the limitations imposed by the materials heretofore utilized. Accordingly, it is a still further object of the invention to provide a doll structure that incorporates a synthetic resinous gelatinous material that may be incorporated in various parts of the doll, such as the cheeks and buttocks, to impart a more realistic appearance to the doll, thus enhancing the simulation to a live child.

One of the characteristics often found in dolls that detracts from the simulation of a live doll is the weight factor. Most dolls are very light in comparison to a live child of approximately the same size, and this lightness or lack of weight has an affect on the manner in which the doll is handled by a child. Another characteristic that determines the degree of simulation of a doll body to a live child is the "feel" of the body parts of the doll in response to the sense of touch. The human skin is soft and pliant, yet elastically deformable to the touch. Accordingly, a still further object of the invention is the provision of a doll structure incorporating a marriage of soft, pliant and elastically deformable materials with a synthetic resinous material that possesses a weight characteristic that will impart to the doll structure both the "feel" and the weight of a live child.

The invention possesses other objects and features of advantage, some of which, with the foregoing, will be apparent from the following description and the drawings. It is to be understood however that the invention is not limited to the embodiment illustrated and described, since it may be embodied in various forms within the scope of the appended claims.

SUMMARY OF THE INVENTION

In terms of broad inclusion, the doll structure of my invention comprises a doll body constructed in part or in whole from an appropriate elasto-polymer material having a density and compressibility that simulates the weight and "feel" of human tissue. When the entire body is fabricated from the elasto-polymer material, it may be injection molded in combination with other materials such as synthetic resinous "fiber-fill", a material that comprises multiple filaments formed into a loose mat which can be placed within the body parts of the doll structure to provide bulk and form, while the elasto-polymer provides the weight characteristic desired to simulate the weight of a human child. In another aspect of the invention, the body parts of the doll may be independently fabricated utilizing an elasto-polymer material as a core material, with fiber-fill surrounding the core to provide bulk and form to the body part, and a covering enclosing the part in simulation of the skin of a human child. In a third aspect of the invention, the body parts of the doll structure may be fabricated from a laminated assembly of a weight-contributing layer of elasto-polymer bonded to a layer of open-celled foam for example, to provide bulk and form, which is in turn appropriately bonded to a fabric covering, woven or otherwise, which contributes the "look" and "feel" of human skin to the combination. This laminated assembly may be preformed into a selected configuration to represent a leg, or arm or head or trunk for the doll structure.

BRIEF DESCRIPTION OF THE DRAWINGS

FIG. 7 is an enlarged cross-sectional view of a variant form of laminated assembly arranged to provide the weight, "feel" and form characteristics desirable in a doll structure.

FIG. 8 is an enlarged cross-sectional view of still another variant form of pre-formed laminated structure that may be utilized to form doll body parts.

FIG. 9 is an enlarged cross-sectional view of yet another variant form of pre-formed laminated structure for the formation of various doll body parts.

FIG. 10 is an enlarged fragmentary perspective view of a pre-formed doll body component, a portion of the component is broken away to reveal the underlying parts, and one end of the component is shown in cross-section to illustrate the relationship of its parts.

FIG. 11 is a perspective view of a pre-formed doll body component constructed utilizing the materials illustrated herein and shaped to be incorporated in the doll structure to provide realism of form, "feel" and weight to the doll structure.

FIG. 12 is an enlarged cross-sectional view of a doll body portion illustrating a variant arrangement of the components that form the body portion.

DESCRIPTION OF THE PREFERRED EMBODIMENT

Figure 1:
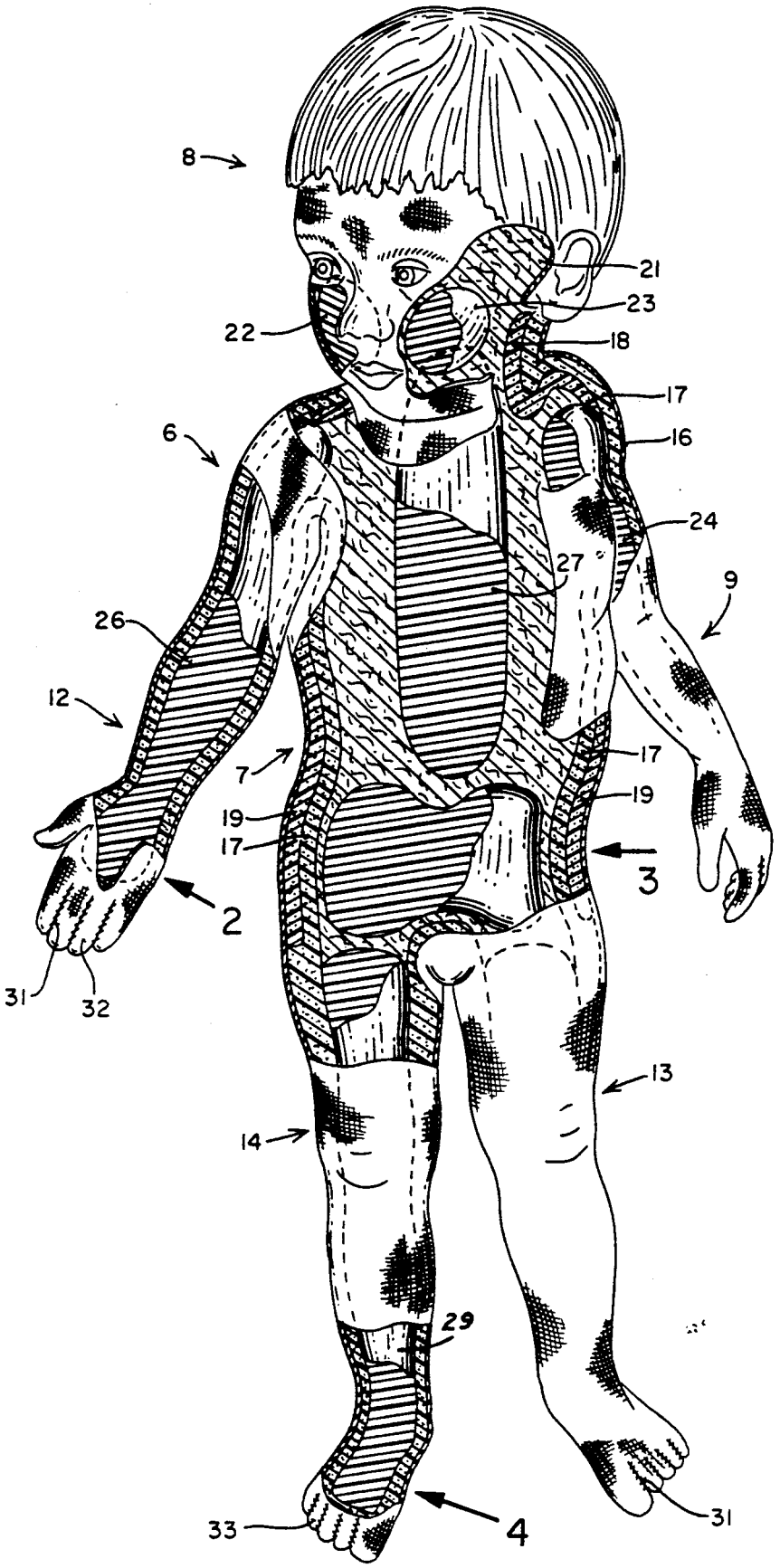
FIG. 1 is a perspective view of a doll structure fabricated according to the invention, portions of the doll body being broken away to reveal underlying structure.
Figure 2:
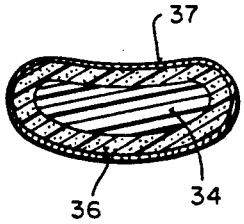
FIG. 2 is a cross-sectional view illustrating the construction of one of the hands of the doll structure as indicated by the arrow 2 in FIG. 1.

In terms of greater detail, the doll structure of the invention is illustrated in FIG. 1, and as there shown comprises a doll body designated generally by the numeral 6, and including a trunk or torso portion designated generally by the numeral 7, a head portion designated generally by the numeral 8, left and right arm portions designated generally by the numerals 9 and 12 respectively, and left and right leg portions designated generally by the numerals 13 and 14, respectively, all of these portions being interconnected as illustrated to form a composite doll body possessing the weight, "feel" and appearance of a live child of approximately the same size as the doll body.

Doll designers have striven for many years to produce a doll structure that would more closely simulate the appearance of a live child, so that a measure of realism could be introduced in the relationship between a live human child and its playmate, simulated by a doll structure having various attributes. Thus, dolls have been constructed with artificial "voice boxes" that respond to the touch of a button to play a recorded message. Other doll structures have been designed so that the doll closes its eyes when the doll is placed in a prone or near horizontal position, thus simulating that the doll is asleep. Still other manufacturers, in an attempt to increase the simulation of "realism" have designed doll structures that cry "Mama" or that "wet" their clothing to simulate natural bodily functions. Dolls have been used for many other purposes besides entertainment of young people. For instance, the Mayo Medical Clinic utilizes a "doll" in the form of a puppet that may be manipulated by a doctor to instruct young patients in the medical procedures or operations they are about to undergo. Young patients may unzip areas of the "doll" or puppet to view a variety of simulated vital organs formed from cloth and contained within the doll body.

Despite all this effort by doll designers, I have not found, after diligent search, any indication of the production of a doll structure that incorporates material that lends weight to the doll structure to simulate the natural weight of a child of approximately the same size.

Referring to the drawings, particularly FIG. 1, it will there be seen that a doll structure has been formed having an outer "skin" covering 16 that covers the entire body, here shown formed as a unitary monolithic structure, but obviously formable as independent body parts that are then interrelated and interconnected to form the complete doll structure. In the doll structure illustrated, immediately below the "skin" covering 16 there is provided a layer 17 of material, such as, for example, open-celled synthetic resinous material that may be bonded to the "skin" layer 16, and which is soft and pliant and possesses sufficient thickness to provide support for the "skin" layer 16, while being susceptible to elastic deformation when squeezed or pressed, in the same manner that human tissue is soft and elastically deformable when squeezed or pressed. I have found that an open-celled urethane-type is satisfactory for this layer 17, and bonds well with the "skin" layer 16, which may be formed from several different materials including woven and unwoven fabrics, treated or untreated for moisture impermeability, or latex, vinyl or rubber type compositions that are non-toxic and soft to the touch to achieve maximum realism.

As illustrated in FIG. 1, the layer 17 of open-celled material may be continuous, or it may be formed in portions 18 that are utilized in areas such as the neck area where the portion may be pre-formed to create the bight necessary between the shoulders and the neck for purposes of realism. Other portions 19 may be used in the waist area, superimposed over the layer 17, to provide form to the body in this area, again for the purpose of achieving realism in the appearance of the doll body.

In some areas, such as the head 8, it may be desirable to provide a filler material of a different type to fill the large inner void in the head. For this purpose, I have found that filling the void with a resilient body 21 of fiber-fill provides the bulk necessary to fill the void and retain the layers 16 and 17 in the proper form. The fiber-fill comprises a multiplicity of synthetic resinous filaments formed into a loose mat or body that may be shaped to whatever configuration is necessary in a given situation. For instance, as shown in FIG. 1, the fiber-fill mat or body 21 continues from the void in the head, through the central void in the neck area, fills the void in the chest area that is not filled by other material as will hereinafter be explained, fills the void in the abdomen area and continues down into the legs, and even into the arms, where appropriate, as will be explained. It should be understood that the purpose of the fiber-fill mat or body 21 is at least two-fold: to fill voids not otherwise filled with other materials and thus provide form to the layers 16 and 17; and to provide support within the voids where it is located for other materials included within these voids, as will now be explained.

Referring to the head portion 8 illustrated in FIG. 1, it will be seen that the fiber-fill mat or body 21 serves to support and retain in proper position relatively small independent bodies or masses 22 and 23 of an elastopolymer type material having relatively greater density and weight than the fiber-fill material and which function to form the protrusions in the face that simulate cheek bones. The polymer mass is preferably a solidified yet soft, pliant and deformable mass of gel material of which there are many types. One of the preferred attributes of the gel material utilized in my doll structure is, that it not be hydrophilic.

In addition to the two preferably pre-formed masses 22 and 23 of gel material to form simulated cheek bones, there is provided a pre-formed polymer gel mass 24 in the left arm 9, and a similar pre-formed polymer gel mass 26 in the right arm 12. It should be noted that the gel masses 24 and 26 for use in the arms are elongated members that are shaped or configured to provide the proper proportions for realism in the shape of the arm, and that the layers 16 and 17 are superposed over the gel mass and contiguous with its outer surface. Preferably, the layer 17 of open-cell foam material is adhesively secured to the internal polymer gel mass to render the mass immobile in relation to the outer covering of the arm. However, because of the configuration of the parts, it is feasible that the polymer gel mass be merely enveloped by the surrounding open cell foam layer 17. However secured, the inner mass of polymer gel imparts a weight factor to each of the arms that they would not otherwise possess, and thus adds to the realism of the doll structure in that each arm simulates the weight of a live human child.

To provide the same realism to the torso or trunk of the doll structure, there is provided generally centrally located within the hollow trunk an elongated polymer gel mass 27 that lies nested within the mat or body of fiber-fill material 21, and thus supported is undetectable from the exterior of the doll structure, yet imparts to the torso or trunk portion of the doll structure the weight necessary to simulate the weight of a live human child. The elongated polymer gel mass 27 extends generally from the neck area of the doll to the hip area as shown. It will of course be obvious that the configuration of the polymer gel mass 27 may be altered to serve various purposes besides add weight to the doll body. For instance, the polymer gel mass 27 may be pre-formed to provide the configuration illustrated in FIG. 11 to provide a protrusion 28 to simulate the buttocks of the doll body. Alternatively, the polymer gel mass 27 may be pre-formed to have a hollow interior, and may extend the full length of the body of the doll, even into the arms and legs, in a layer of appropriate thickness to provide the weight that would simulate the natural weight of a live child. The hollow within the body of polymer gel is then filled with fiber-fill material as previously discussed, to retain the form of the doll.

Referring again to FIG. 1, it is there shown that each of the legs 13 and 14 are provided with a polymer gel mass 29 that shapes the leg and provides a base for the application of the overlying layer 17 of open-cell foam material and the superposed layer 16 of "skin" material. It should be noted that because of the compressibility of the foam layer 17, and the deformability of the underlying polymer gel mass, it is possible to provide stitching 31 through the hand and foot members to simulate the existence of fingers 32 and toes 33.

Referring to the detailed illustrations of FIGS. 2 through 12, inclusive, the purpose of these views is to illustrate the various ways in which the components that make up doll body portions may be fabricated utilizing the elements discussed above. Thus, it will be seen from FIG. 2 that there is provided a central core 34 of polymer gel, surrounded by a layer 36 of open-cell foam material conforming to the configuration of the central core. Surrounding and containing the foam layer 36 is a layer 37 of "skin" material, which may be any of those ennumerated above. Preferably, the layer 37 is bonded to the underlying layer 36 of foam, and while the view illustrates a cross-section, it should be noted that the component may be of any length necessary for a particular body portion.

Figure 3:
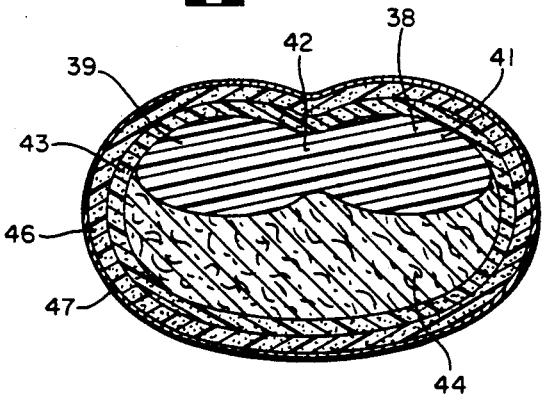
FIG. 3 is a cross-sectional view of the doll body taken at the location of the arrow 3 in FIG. 1, and illustrating one aspect of the construction at the location indicated.

FIG. 3 illustrates another assembly arrangement in which there is provided a pre-formed polymer gel mass 38 having the characteristics discussed above, but formed to provide two "lobes" 39 and 41 joined by a narrow isthmus 42. This pre-formed polymer gel mass functions as a core, and is surrounded by a layer 43 of open-cell foam of substantially larger outer diameter than the core material. The void between the core material and the layer 43 of open-cell material is filled with a body 44 of fiber-fill material to hold the layer 43 of open-cell foam material extended as shown. This entire assembly is then further surrounded, when necessary or desirable, with a further layer 46 of open-cell foam material. Lastly, the assembly is encased in a "skin" like layer 47 of the type previous discussed to give the "feel" and appearance of human skin.

Figure 4:
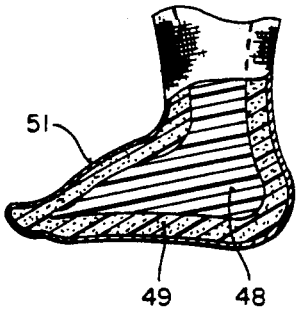
FIG. 4 is a side elevational view of one foot of the doll structure, as indicated by the arrow 4 in FIG. 1, including a portion of the ankle, with the foot portion shown in cross-section to illustrate its construction.

FIG. 4 illustrates a foot portion of the doll structure fabricated to include a pre-formed core 48 of polymer gel, surrounded by a layer 49 of soft, pliant open-cell foam material of the type previously discussed, fitting snugly about the preformed core 48 as shown. The "skin" layer 51 is then applied directly to the foot portion over the foam layer 49 to provide the simulated appearance of human tissue.

Figure 5:
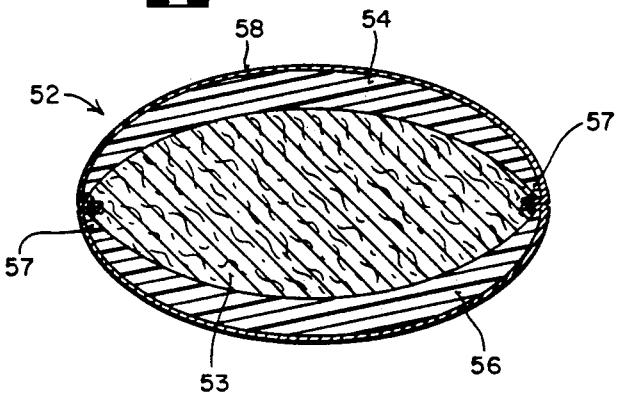
FIG. 5 is a cross-sectional view of a variant form of construction of the torso or trunk of the doll structure incorporating a pre-molded laminated assembly.

In FIG. 5, there is shown another assembly designated generally by the numeral 52, and being a generally ovate body fabricated to include a central mat or body 53 of fiber-fill to define the girth of the part, with the outer surface of the fiber-fill body overlayed with two oppositely disposed layers 54 and 56 of soft, pliant and elastically resilient polymer gel, the lateral edges 57 of which are tapered to relatively sharp edges as shown. Because of the composite structure of this component, the outer covering 58 or "skin" is formed from appropriate woven or unwoven material applied in a thin layer over the polymer gel slabs 54 and 56, with the associated edges of the outer covering 58 being stitched internally as at 59 to completely encase the assembly of fiber-fill and polymer gel slabs, retain them their relative positions, and provide the appearance of human tissue. It will thus be seen that in this assembly the fiber-fill body provides the bulk or girth the two slabs 54 and 56 of polymer gel provide the weight necessary to simulate the weight of a live child, while the outer covering 58 provides the "feel" and appearance of human tissue.

Figure 6:
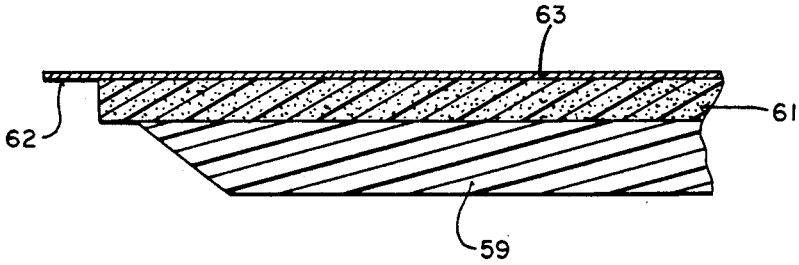
FIG. 6 is an enlarged fragmentary cross-sectional view of a laminated assembly of elasto-polymer, open-cell foam and a skin-like covering material that may be used for various parts of the doll structure.

FIG. 6 is a fragmentary view of a pre-formed component illustrating the interrelationship of a body 59 of polymer gel bonded to a layer 61 of soft, pliant and elastically resilient open-cell foam material, which is in turn bonded to the inner surface 62 of a "skin" layer 63 of vinyl, latex, rubber or woven or unwoven fabric, treated or not for permeability of moisture. This construction may be pre-formed in various configurations and applied where necessary on the doll structure to provide the necessary thickness, weight and appearance.

The particular assembly of components of a doll part are often dictated by the nature of the part and the appearance sought for the part. Some body parts are best fabricated to have an ovate configuration, while others may be fabricated to possess a cylindrical configuration. Thus, referring to FIG. 7, there is there shown a generally ovate member designated generally by the numeral 64 and fabricated to include a central core or body 66 of fiber-fill surrounded by a tubular layer 67 of polymer gel to provide the weight factor necessary for realism. The body 66 of fiber-fill holds the tubular layer 67 of polymer gel extended as shown in a generally ovate configuration, and this base assembly is then surrounded by a layer 68 of fiber-fill. Thereafter, there is applied a layer 69 of soft, pliant elastically resilient foam material which provides the soft, pliant "feel" of human tissue, with the foam material then being covered by a layer 71 of a material such as latex, rubber or fabric, woven or unwoven as previously discussed. When a fabric is utilized it may be of the "stretch" variety that will tightly encompass the enclosed mass and provide a smooth surface on the part.

In the illustration of FIG. 8 of a cylindrical component, the core 72 is constitutes a cylindrical body of polymer gel, the length being determined by the location in the body where the part is to be used. Surrounding the cylindrical core 72 of polymer gel is a tubular fiber-fill mat 73 of sufficient thickness to provide the desired diameter to the member. To provide the flexibility and elastic deformability necessary to simulate human tissue, the fiber-fill mat 73 is in turn surrounded by a tubular layer 74 of soft, pliant open-cell foam as previously described, and surrounding the foam layer 74 is a layer 76 of simulated "skin" formed as before from a latex sheet, or other suitable covering material, such as fabric, woven or unwoven.

The structure illustrated in FIG. 9 presents a different arrangment in that the core 77 is an ovate body of fiber-fill compacted to the desired degree to produce the dimensions necessary for the doll part. Surrounding the core 77 of fiber-fill there is superposed a tubular layer 78 of polymer gel which, in this case functions not only to provide the necessary weight to simulate the weight of a live child, but also to provide the soft, pliant and elastically resilient compressibility that simulates these qualities in human tissue. Surrounding the tubular layer 78 of polymer gel there is provided a layer 79 forming a "skin" surrounding the entire part. This layer is preferably formed from a "stretch" type material so that seams are eliminated, the material being pulled over and tightly enveloping the underlying layer of polymer gel.

In some instances, it is expedient that the weight contributing polymer gel material be arranged in a plurality of elongated "sticks" of relatively small diameter, and having a length determined by the location on the doll body where the part that incorporates them is to be placed. Thus, in FIG. 10, there is illustrated an elongated member designated generally by the numeral 81, and comprised of a plurality of elongated polymer gel "sticks" 82 arranged in side-by-side juxtaposition as shown, and preferably supported within the central void of a tubular fiber-fill mat 83 that functions to give girth and bulk to the component, while retaining the "sticks" of polymer gel in juxtaposed position as shown. Surrounding the cylindrical and tubular mat 83 of fiber-fill is a tubular layer 84 of a soft, pliant and elastically compressible open-cell foam material, which is then enclosed within a layer 86 forming a "skin" about the structure as previously described. Thus, the polymer gel within the member provides the weight necessary to impart realism to the member, while the softness of the foam layer 84 and the soft and pliable covering 86 provide the "feel" and appearance of human tissue.

The component illustrated in FIG. 11 comprises a pre-formed trunk or torso core designated generally by the numeral 87 and formed from polymer gel in the form of a channel member having a web 88 and opposite flanges 89 and 91 defining the channel. As previously discussed in connection with FIG. 1, the end of the channel member is provided with a protrusion 28 that serves the purpose of defining the buttocks of the doll structure when the channel member is suspended within the doll body. The channel member is of course surrounded after its placement with fiber-fill material and soft, pliant and elastically compressible open-cell foam material as previously discussed.

Lastly, there are times during the fabrication or construction of a doll body when it is essential to provide a concentration of weight in a relatively small diameter member. This result is accomplished by the structure illustrated in FIG. 12 in which the entire core 92 is formed from soft and compressible polymer gel, which is the enveloped within the tubular sleeve or covering 93 of latex, or fabric to provide the "feel" and appearance of human tissue.

From the foregoing it will be seen that I have produced a doll structure or body from materials that have not heretofore been used for this purpose. A doll manufactured utilizing the materials and methods discussed herein possesses a weight factor that closely resembles the weight factor of a human child of approximately the same size. The choice of materials and their interrelationship also provides the elastic compressibility that simulates human tissue, and the "skin" that is applied to the doll body parts imparts a realism not heretofore available in a doll.

Having thus described the invention, what is believed to be new and novel and sought to be protected by letters patent of the United States is as follows.

I claim:

1. A doll structure, comprising:

a) a doll body including trunk, head, arms and legs interconnected to form a composite simulation of a human child;

b) means within said doll body having a density attributing to said doll body a weight factor approximately the weight factor of a live child of approximately the same size;

c) means covering the exterior surface of the doll body and simulating the "feel" and appearance of human tissue;

d) said means within the doll body having a density attributing to said doll body a weight factor approximating the weight of a live child of approximately the same size comprising one or more masses of a soft, pliant, elastically compressible polymer gel material; and e) said mass of soft, pliant and elastically compressible polymer gel material is hollow, and the hollow within said mass is filled with a soft, pliant and compressible mass of fiber-fill material constituting a mat of unoriented separate filaments of natural or synthetic fibers the density of which is less than the density of the mass of polymer gel material.

2. A doll structure, comprising:

a) a doll body including trunk, head, arms and legs interconnected to form a composite simulation of a human child;

b) means within said doll body having a density attributing to said doll body a weight factor approximately the weight factor of a live child of approximately the same size;

c) means covering the exterior surface of the doll body and simulating the "feel" and appearance of human tissue;

d) said means within the doll body having a density attributing to said doll body a weight factor approximating the weight of a live child of approximately the same size comprising one or more masses of a soft, pliant, elastically compressible polymer gel material; and e) selected parts of said doll body include a core of said polymer gel material, a layer of unoriented filaments forming a mat about said core of polymer gel material, and a layer of soft, pliant material forming a covering over the exterior surface of said doll body part to simulate the "feel" and appearance of human tissue.

3. A doll structure, comprising:

a) a doll body including trunk, head, arms and legs interconnected to form a composite simulation of a human child;

b) means within said doll body having a density attributing to said doll body a weight factor approximately the weight factor of a live child of approximately the same size;

c) means covering the exterior surface of the doll body and simulating the "feel" and appearance of human tissue;

d) said means within the doll body having a density attributing to said doll body a weight factor approximating the weight of a live child of approximately the same size comprising one or more masses of a soft, pliant, elastically compressible polymer gel material; and e) selected parts of said doll body include a core of unoriented filaments arranged into a mat of selected configuration; a pair of slabs of a soft, pliant and elastically compressible polymer gel material surrounding said core mat of unoriented filaments, said slabs of polymer gel material each having a thickness along a median plane greater than at their edges; and a layer of soft and pliant material covering said slabs of polymer gel material and being contiguous thereto on the sides thereof opposite said core mat of unoriented filaments.

4. A doll structure, comprising:

a) a doll body including trunk, head, arms and legs interconnected to form a composite simulation of a human child;

b) means within said doll body having a density attributing to said doll body a weight factor approximately the weight factor of a live child of approximately the same size;

c) means covering the exterior surface of the doll body and simulating the "feel" and appearance of human tissue;

d) said means within the doll body having a density attributing to said doll body a weight factor approximating the weight of a live child of approximately the same size comprising one or more masses of a soft, pliant, elastically compressible polymer gel material; and e) selected parts of said doll body include a core mat of unoriented filaments pre-formed into a selected configuration; a tubular layer of polymer gel material surrounding said core mat and conformable to the configuration thereof; a tubular mat of unoriented filaments surrounding said tubular layer of polymer gel material and conformable to the configuration thereof; a tubular layer of a soft, pliant and elastically compressible foam material surrounding said tubular mat of unoriented filaments and conformable to the configuration thereof; and a layer of soft and pliant material covering the exterior surface of the assembly thus formed to impart the "feel" and appearance of human tissue to the part.

5. A doll structure, comprising:

a) a doll body including trunk, head, arms and legs interconnected to form a composite simulation of a human child;

b) means within said doll body having a density attributing to said doll body a weight factor approximately the weight factor of a live child of approximately the same size;

c) means covering the exterior surface of the doll body and simulating the "feel" and appearance of human tissue;

d) said means within the doll body having a density attributing to said doll body a weight factor approximating the weight of a live child of approximately the same size comprising one or more masses of a soft, pliant, elastically compressible polymer gel material;

e) said one or more masses of polymer gel material comprising a plurality of elongated "sticks" of polymer gel material arranged in side-by-side juxtaposed position, said plurality of "sticks" of polymer gel material are surrounded by a tubular mat of unoriented filaments closely enveloping and supporting said "sticks" of polymer gel material, a tubular layer of soft, pliant and elastically compressible foam material surrounding said tubular mat of unoriented filaments on the side thereof opposite said "sticks" of polymer gel material, and a layer of soft and pliant sheet material constituting a membrane surrounding said tubular layer of soft, plaint and elastically compressible foam material on the side thereof opposite said tubular mat of unoriented filaments.

* * * * *